United States Patent [19]

Czelusniak, Jr. et al.

[11] Patent Number: 4,825,630

[45] Date of Patent: May 2, 1989

[54] METHOD AND APPARATUS FOR AIR SPLICING YARN

[75] Inventors: Paul A. Czelusniak, Jr.; Milton R. Crouch, both of Eden, N.C.

[73] Assignee: Fieldcrest Cannon, Inc., Eden, N.C.

[21] Appl. No.: 143,125

[22] Filed: Jan. 12, 1988

Related U.S. Application Data

[62] Division of Ser. No. 89,753, Aug. 26, 1987, abandoned.

[51] Int. Cl.[4] ..... D01H 15/00; B65H 69/06

[52] U.S. Cl. ..... 57/22; 57/261

[58] Field of Search ..... 57/22, 202, 261, 263

[56] References Cited

U.S. PATENT DOCUMENTS

| | | | |
|---|---|---|---|
| 1,986,974 | 1/1935 | Kellogg | 57/22 |
| 2,605,603 | 8/1952 | Willis | 57/22 |
| 2,705,862 | 4/1955 | Steiger et al. | 57/22 |
| 2,808,356 | 10/1957 | Kimball | 57/22 |
| 2,844,859 | 7/1958 | Griset, Jr. | 57/22 |
| 3,306,020 | 2/1967 | Rosenstein | 57/22 |
| 3,379,002 | 4/1968 | Rosenstein | 57/22 |
| 3,380,135 | 4/1968 | Wood et al. | 57/22 |
| 3,407,583 | 10/1968 | Irwin et al. | 57/22 |
| 3,461,661 | 8/1969 | Irwin et al. | 57/22 |
| 3,474,615 | 10/1969 | Irwin et al. | 57/22 |
| 3,487,618 | 1/1970 | Arguelles | 57/22 |
| 3,526,085 | 9/1970 | Illman | 57/22 |
| 3,634,972 | 1/1972 | Illman | 57/22 |
| 3,643,417 | 2/1972 | Irwin | 57/22 |
| 4,048,277 | 9/1977 | Breznak et al. | 57/22 |
| 4,143,506 | 3/1979 | Pierce et al. | 57/22 |
| 4,229,935 | 10/1980 | Wain | 57/22 |
| 4,397,137 | 8/1983 | Davies et al. | 57/22 |
| 4,437,298 | 3/1984 | Truzzi et al. | 57/22 |
| 4,441,308 | 4/1984 | Rohner et al. | 57/22 |
| 4,444,004 | 4/1984 | Rankin et al. | 57/22 |
| 4,485,615 | 12/1984 | Pigalev et al. | 57/22 |
| 4,492,076 | 1/1985 | Romic et al. | 57/22 |
| 4,537,019 | 8/1985 | Matsui et al. | 57/22 |
| 4,667,864 | 5/1987 | Kiteck | 57/22 |

FOREIGN PATENT DOCUMENTS

| | | | |
|---|---|---|---|
| 145075 | 11/1981 | Japan | 57/22 |
| 956992 | 4/1964 | United Kingdom | 57/22 |
| 2074199 | 10/1981 | United Kingdom | 57/22 |

*Primary Examiner*—Donald Watkins

*Attorney, Agent, or Firm*—Bell, Seltzer, Park & Gibson

[57] ABSTRACT

Air spliced yarn and associated method and apparatus for forming the spliced yarn. The spliced yarn has the ends extending in a common direction laterally of the body of the yarn with the fiber components of the spliced ends of yarn being intimately entangled with each other and forming a commingled projection of entangled fiber components extending laterally from the body of the yarn. The spliced yarn is disclosed for connecting a running package of yarn to a reserve package of yarn as in a yarn creel feeding a bank of yarns to a carpet tufting machine.

The apparatus comprises a hand held manually actuatable air valve for compressed air connected to a housing having a hollow wall. The housing has an open ended passageway therethrough for receiving side-by-side yarn ends facing in the same direction. A series of openings for entrance of compressed air into the passageway extend through the inner wall of the housing for effecting air entanglement of the ends of yarn positioned in the passageway.

9 Claims, 2 Drawing Sheets

METHOD AND APPARATUS FOR AIR SPLICING YARN

This application is a division of copending application Ser. No. 089,753, filed Aug. 26, 1987, now abandoned.

BACKGROUND OF THE INVENTION

This invention relates to joining or connecting textile yarns of a variety of types to each other as when yarn is parted or broken and more particularly to splicing yarn to maintain continuous operation of a textile machine fed from packages of yarn in a creel as in the forming of pile carpets by tufting machines having relatively large creels associated therewith.

In the tufting of carpets the creels for the packages of yarn have the yarn packages arranged in cooperating pairs, one package being the running package of yarn and the other package adapted to serve as a reserve package. The trailing end of yarn from the running package is connected to the leading end of the reserve package as by the creel attendant manually tying the ends together or by the attendant using an adhesive to adhesively splice the yarns together.

Neither of these conventional techniques for connecting yarns has been entirely satisfying. The large size of knot resulting from the manually tied yarns has oftentimes presented critical problems in the form of tufting machine stoppage particularly for certain larger sizes of yarn due to yarn breakage resulting from snagging of the tied knots on the tufting needles preventing their passage through the eyes of the tufting needles. On the other hand the use of adhesive is messy to handle and necessitates the creel attendant always carrying a container of adhesive on their body.

Air splicers are also known in the prior art but are not widely used because of their bulky nature, high cost and tedious and time consuming method of operation. In these air splicers the ends of the yarns to be spliced are arranged within the bore or passageway of the splicer beside each other and facing in opposite directions. The bore is typically open-sided as by being provided with a slot extending along its length which may have a lid for closing the slot. In operation pressurized air is directed transversely into the bore to effect entanglement of the fibers or filaments of the ends of the yarn with each other.

SUMMARY OF THE INVENTION

With the foregoing in mind it is the primary purpose of this invention to provide a unique spliced yarn product and relatively simple method and apparatus for obtaining the same.

The spliced yarn product of this invention basically differs from the prior art by having the ends of yarn extending in a common direction beside each other instead of in opposite directions. Desirably the ends of yarn are coextensive with the fibers or filaments thereof being intimately entangled and forming a commingled projection of entangled fiber components extending laterally from the body of the yarn. It has been determined by extensive tests that this lateral projection of entangled fibers on the spliced yarns does not interfere with the passage of the yarns through the eyes of tufting needles as well as through various textile yarn guides, yarn tension devices and other instrumentalities associated with the handling of yarns and the processing thereof into various types of textile fabrics and products.

It is a further object of this invention to provide a manually actuatable air splicer that may readily be mounted on a conventional hand held valve of the type widely used throughout the textile industry connected to a relatively long air hose for blowing accumulated lint off of textile machinery and creels associated therewith. The air splicer of this invention takes the simple form of a housing having an open ended passageway therethrough and into one end of which the ends of yarn to be spliced are inserted with the ends of yarn facing in the same direction and beside each other and desirably having coextensive ends. One or more series of openings for compressed air extend through the housing and communicate with the passageway for compressed air to enter the passageway and effect air entanglement of the ends of yarn positioned in the passageway.

BRIEF DESCRIPTION OF THE INVENTION

Some of the objects and advantages of the present invention having been stated others will appear as the description proceeds when considered in conjunction with the accompanying drawings in which FIG. 1 is a schematic view of a tufting machine for producing tufted carpets and wherein a creel for the yarn packages is shown in association therewith and with the invention being positioned along the aisles and readily accessible to the creel attendant for air splicing yarns;

FIG. 2 is fragmentary view of a pair of cooperating packages of yarn from a yarn creel of the type as illustrated in FIG. 1 and wherein the trailing end of yarn from the running package is shown as air spliced to the leading end of the reserve package; further the creel attendant is shown using the conventional air nozzle for blowing and pneumatically conveying a parted creel yarn from the running package to the tufting machine through the plastic tubes extending therebetween;

DETAILED DESCRIPTION OF THE DRAWINGS

Figure 1:
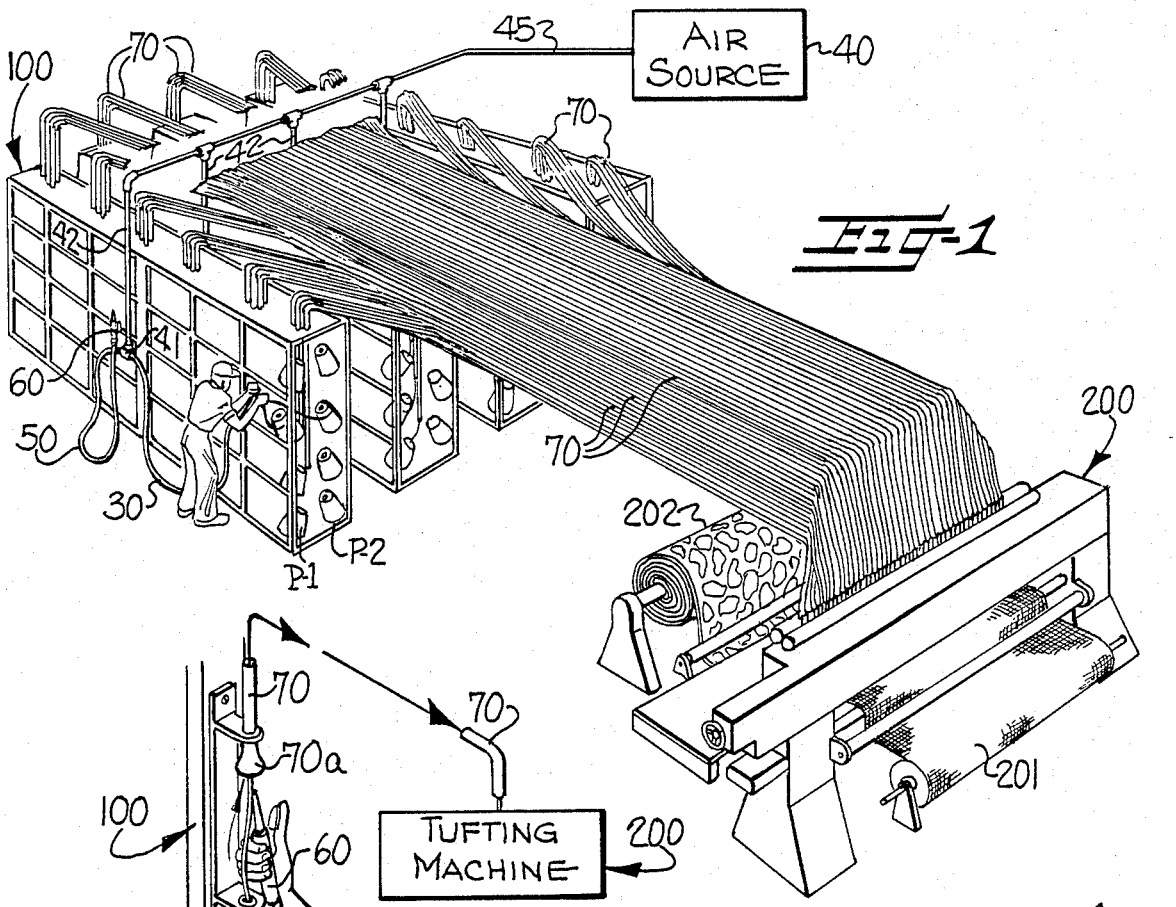
Figure 2:
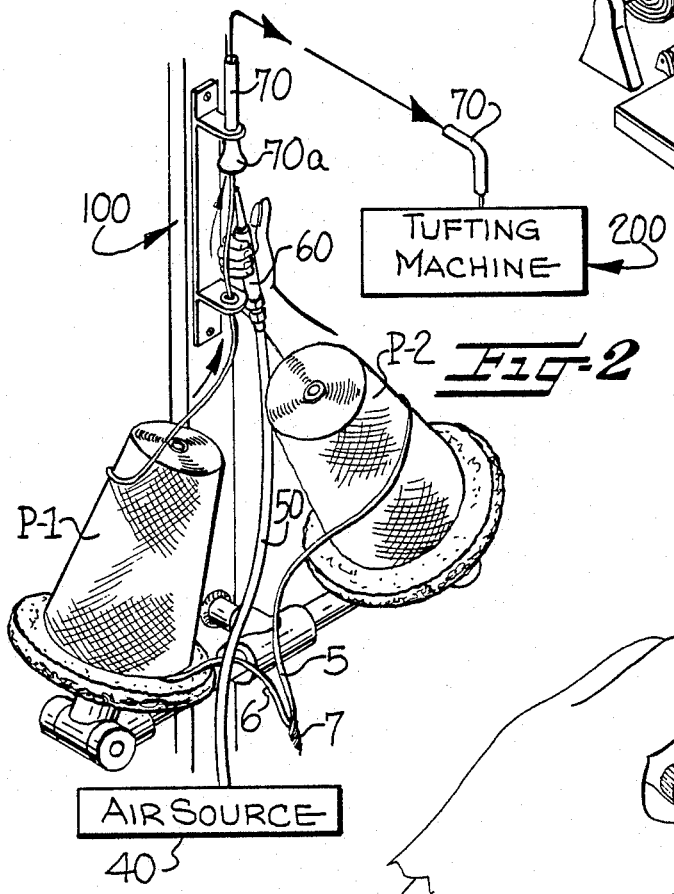
Figure 3:
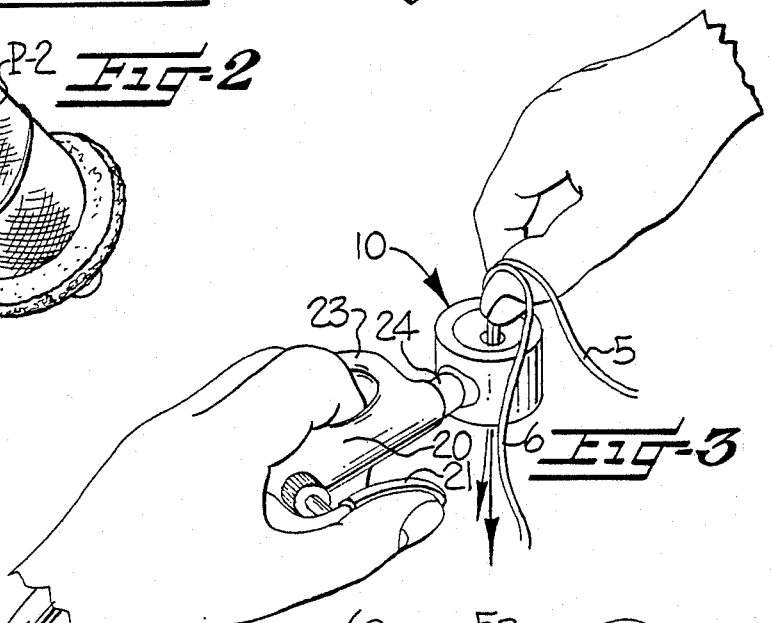
FIG. 3 is a schematic view illustrating the creel attendant utilizing the air splicer of this invention for effecting an air splice in the ends of the yarn.

Referring now specifically to the drawings and particularly to FIGS. 1 to 3, the air splicer broadly indicated by reference numeral 10 (FIG. 3) is shown associated with an air hose 30 positioned along a textile creel 100 having a plurality of packages of yarn positioned thereon with the packages arranged in cooperating pairs P-1, P-2 and serving as a yarn supply for a tufting machine broadly indicated by reference numeral 200. The tufting machine 200 as illustrated has a backing fabric 201, which is fed into the machine in a conventional manner wherein tufting needles provide tufts extending from the fabric 201 after which the same is wound into a roll 202 as the fabric is fed from the machine.

Extending between the creel 100 and the tufting machine 200 are a plurality of plastic tubes 70 each containing a yarn feeding from one of the running packages P-1 to the tufting machine. It will be understood to those versed with tufting machines that these plastic tubes 70 are conventionally utilized and serve for facilitating the piecing up of a broken or parted yarn as by use of a conventional air nozzle 60 carried by the end of another hose 50 also extending alongside of the creel 100. The use of this air nozzle 60 carried by the hose 50 is illustrated in FIG. 2 wherein it will be noted that the nozzle 60 is shown positioned adjacent the flared entrance end 70*a* of a tube 70 for the purpose of pneumatically conveying the textile yarn P-1 to the outlet end of the tube which terminates adjacent tufting needles (not shown) of the tufting machine 200. It will further be noted from FIG. 2 that the package P-1 has its trailing end 6 connected to the leading end 5 of reserve package P-2 by an air splice 7 formed in accordance with this invention.

As will be noted from FIG. 1 an air source 40 is provided to the textile creel 100 for the purpose of serving the various air nozzles 60 that are conventionally provided in association with each aisle of the creel 100. Thus, it will be understood that a source of compressed air is conventionally provided in association with each of the aisles of the creel 100 to thus minimize the changes necessary for accommodating the addition of the air splicer 10 of this invention at each of the aisles of the creel.

As illustrated in FIG. 1, a conventional tee 41 on the outlet end of each branch 42 of an air line 45 is utilized for connecting a hose 30 and air splicer 10 to the air source 40. Hose 30 has mounted on the end thereof a conventional manually actuatable valve means 20 having a depressible lever 21 adapted to be actuated by the creel attendant's thumb as best illustrated in FIG. 3 for opening a conventional valve therein to permit compressed air to flow out of an outlet 24 into the air splicer 10.

For ease in positioning the air splicer 10 out of the way when the same is not being utilized it should be noted that the manually actuatable valve means 20 includes an arcuate handle in the form of a hook member 23 which is adapted to serve for hanging the air splicer 10 on a hook alongside the creel.

Figure 9:
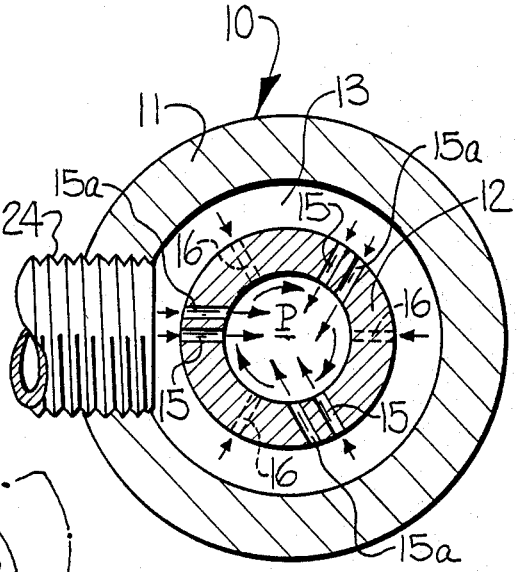
FIG. 9 is a horizontal sectional view of the air splicer taken along line 9—9 of FIG. 8.
Figure 10:
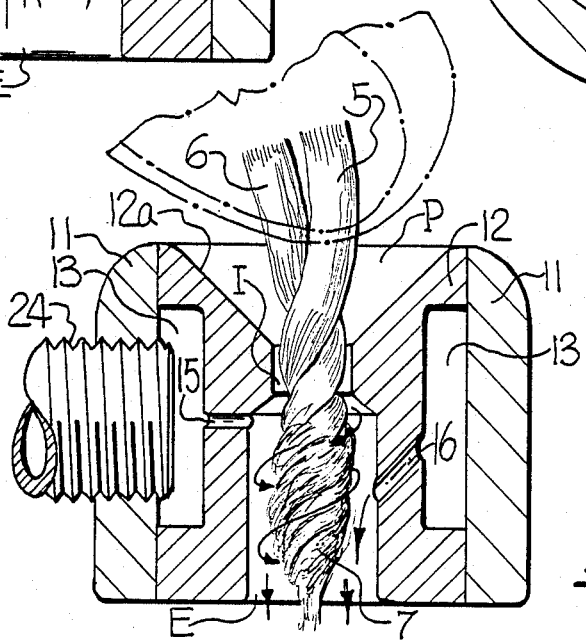
FIG. 10 is a view similar to FIG. 8 but further illustrating the ends of yarn being spliced positioned in the air splicer and being air entangled with each other.

Referring now particularly to FIGS. 7–10 the details of the air splicer 10 will now be given. As illustrated, the air splicer 10 broadly takes the form of a relatively small housing member having a hallow wall member formed by spaced inner and outer walls 11 and 12 respectively, defining an air chamber 13 therebetween. Through a central portion of the housing member is a passageway P which is provided with an inlet end I as defined by a frustoconical or funnel-shaped portion 12*a* (see FIG. 7) and an exit end E remote therefrom. It will be noted that the air chamber 13 serves for receiving compressed air therein through the outlet 24 of the manually actuatable valve 20. The air chamber 13 surrounds the medial portions of the inner wall 12 and communicates with the passageway P of the air splicer by a first series of circularly arranged openings 15, 15*a* provided in medial portions of the inner wall 12. As best shown in FIG. 9, the circularly arranged openings 15, 15*a* are each three in number and arranged in adjacent pairs of one opening of each type. The openings 15 are positioned on the radius of the passageway P while the openings 15*a* are offset from the radius to impart twist to the yarn splice 7. A second series of openings 16 are provided in the inner wall 12 below the openings 15 and also communicate with the air chamber 13. This second series of openings 15 are thus positioned further away from the inlet end I of the passageway P than the first mentioned series of openings 15 and are arranged at an inclined angle in the inner wall 12 oriented toward the exit end of the passageway P so that a suction effect is created in the passageway to draw the ends of the yarns 5, 6 therein. This is best illustrated in FIG. 10 of the drawings in conjunction with FIG. 8.

Figure 4:
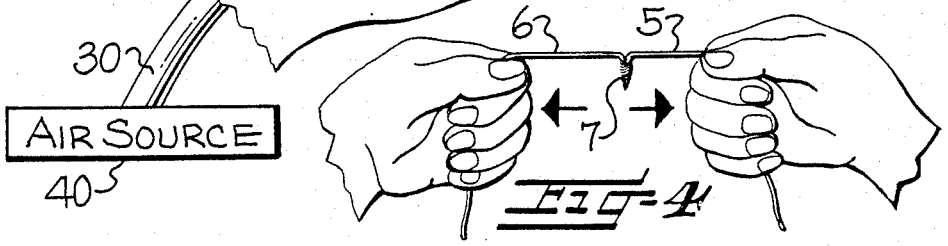
FIG. 4 is a further schematic view of the air spliced yarn wherein the ends that have been air spliced together are shown as being pulled in opposite directions to illustrate the strength of the splice in the yarn.
Figure 5:
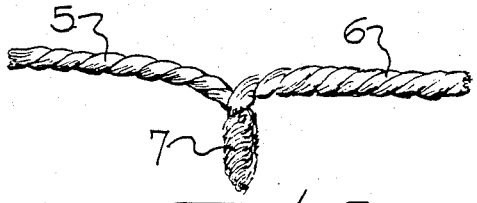
FIG. 5 is a schematic view of a spun plied yarn with a splice formed in accordance with this invention.
Figure 6:
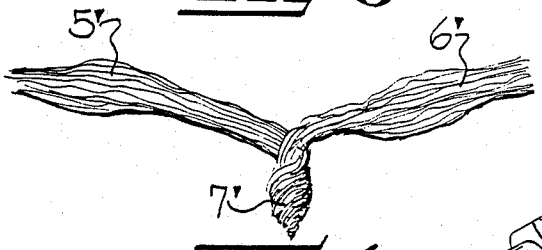
FIG. 6 is a view similar to FIG. 5 but illustrating the splice in the ends of yarn of the type formed from textured filaments.
Figure 7:
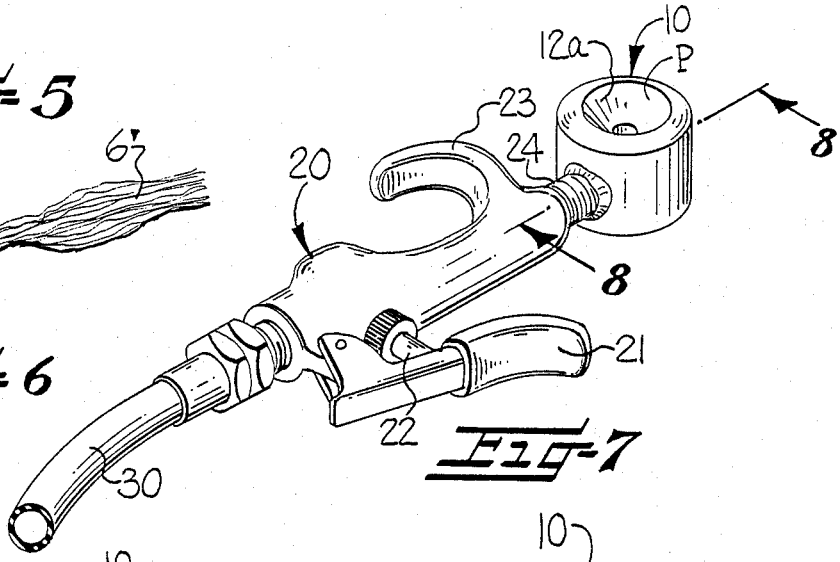
FIG. 7 is a perspective view of the air splicer apparatus of this invention as mounted on the end of a conventional air hose commonly used in textile mills.
Figure 8:
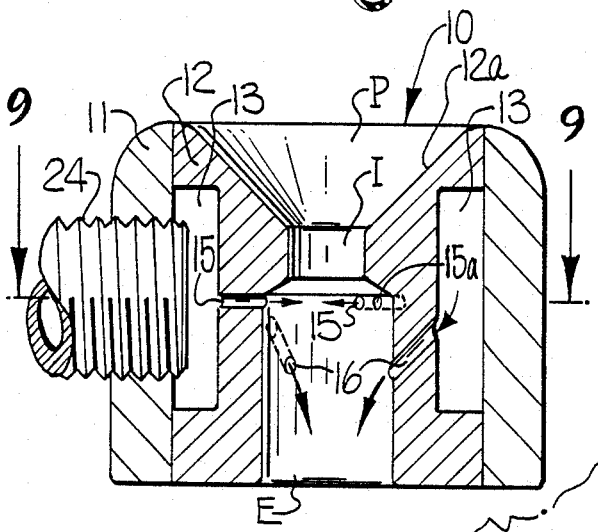
FIG. 8 is a vertical sectional view on an enlarged scale taken along line 8—8 of FIG. 7 and illustrating the interior features of the air splicer.

Referring now to the spliced ends of the yarn product itself, as illustrated in FIGS. 4 to 6, it will be understood that the ends of yarn 5, 6 or 5', 6' extend in a common direction laterally of the body of the yarn to form a commingled projection 7, or 7' with the fiber components of the commingled projection being intimately entangled with each other by the pressurized air passing through the series of openings 15 of the air splicer 10. It will be further understood by those versed in textiles that the fibers of the respective yarn ends 5 and 6 are more receptive to being intermingled and entangled with each other than is the case wherein yarns are spliced in accordance with the prior art wherein the ends of the yarn are very often positioned outside of the air splicer with the entanglement of the ends of the yarn to each other being effected by portions spaced inwardly from the ends of the yarn. This feature of the prior art air entangling of yarns is illustrated in Irwin, et al. U.S. Pat. No. 3,474,615.

It will thus be seen that a unique spliced yarn is provided and wherein the attendant apparatus and method for effecting such splice is very simple and thus serving to encourage textile employees to use this new technology instead of prior practices and their associated shortcomings as noted earlier.

That which is claimed:

1. A method of connecting ends of yarn to each other comprising providing a hand carried manually actuatable air nozzle connected to a pressurized air hose and having a yarn air splicer mounted on and communicating with the air nozzle, the air splicer having a housing with an open ended passageway therethrough surrounded by an air chamber in the walls of the housing communicating with the passageway through a series of circularly arranged openings, air splicing the ends of yarn by simultaneously placing with one hand the ends of yarn into the passageway extending through the air splicer with the ends of yarn being beside each other and facing in a common direction, and while with the other hand holding manually actuating the air nozzle to direct pressurized air into the air splicer and through the series of circularly arranged openings therein and into the passageway extending therethrough for subjecting the ends of yarn therein to air turbulences to effect an entanglement of the fiber components of the ends of the yarn with each other and to impart twist to the entangled ends of the yarn so as to form a commingled projection of entangled fiber components extending laterally from the joined ends.

2. A method according to claim 1 wherein the textile yarns being spliced are spun yarns and the fiber components being entangled are staple fibers.

3. A method according to claim 1 wherein the textile yarns being spliced are multifilament yarns and the fiber components being entangled are filaments.

4. A method according to claim 1 wherein the textile yarns being spliced are multifilament textured yarns and the fiber components being entangled are filaments.

5. A manually actuatable device for splicing yarn comprising a valve adapted to be connected to a source of air pressure, and an air operable yarn splicer connected to said valve; said valve including manually actuatable valve means resiliently held in closed valve position and manually movable to an open position to permit compressed air to pass therethrough and into said yarn splicer, said yarn splicer comprising a housing having an open ended passageway therethrough, said passageway having an inlet end and an exit end, the inlet end serving to receive yarns to be spliced with the ends of the yarns being positioned beside each other and facing in a common direction in the inlet end, the exit end serving for exhaust of the compressed air, said housing having inner and outer walls defining an air chamber therebetween, said valve being connected to said housing so that compressed air flows through the valve into said air chamber, and a series of openings for compressed air extending through said inner wall and serving to provide communication between said air chamber and said passageway for effecting air entanglement of the ends of yarn positioned in the passageway.

6. A manually actuatable device for splicing yarn comprising a flexible hose adapted to be connected to a source of air pressure, a manually actuatable hand held valve connected to said hose, and an air operable yarn splicer connected to said hand held valve; said hand held valve including manually actuatable valve means resiliently held in closed valve position and manually movable to an open position to permit compressed air to pass therethrough and into said yarn splicer, said yarn splicer comprising a housing having an open ended passageway therethrough, said passageway having an inlet end and an exit end, the inlet end serving to receive yarns to be spliced with the ends of the yarns being positioned beside each other and facing in a common direction in the inlet end, the exit end serving for exhaust of the compressed air, said housing having inner and outer walls defining an air chamber therebetween, said hand held valve being connected to said housing so that compressed air flows through the valve into said air chamber, and a series of openings for compressed air extending through said inner wall and serving to provide communication between said air chamber and said passageway for effecting air entanglement of the ends of yarn positioned in the passageway.

7. A device according to claims 5 or 6 including a second series of openings extending through said inner wall and also communicating with said air chamber and said passageway and positioned further away from said inlet end of said passageway than said first mentioned series of openings and thus being downstream of said first mentioned series of openings, and said second series of openings being inclined at an angle oriented toward the exit end of said passageway so that a suction effect is created in the passageway to draw the ends of the yarns therein.

8. An air operable yarn splicer adapted to be connected to a valve connected to a source of compressed air, said yarn splicer comprising a housing having an open-ended passageway therethrough, said passageway having an inlet end and an exit end, the inlet end serving to receive ends of yarn to be spliced with the ends of the yarn being positioned beside each other and facing in a common direction in the inlet end, the exit end serving for exhaust of the compressed air, said housing having inner and outer walls defining an air chamber therebetween, an opening in said outer wall connectable to a valve, a first series of openings for compressed air extending through said inner wall and communicating with said air chamber and said passageway for effecting air entanglement of the ends of yarn positioned in the passageway, and a second series of openings extending through said inner wall and communicating with said air chamber and said passageway and positioned further away from said inlet end of said passageway than said first mentioned series of openings and thus being downstream of said first mentioned series of openings, and said second series of holes being inclined at an angle oriented toward the exit end of said passageway so that a suction effect is created in the passageway to draw the ends of the yarn therein.

9. A yarn splicer according to claim 8 wherein the respective series of openings are circularly arranged around said inner wall.

* * * * *

UNITED STATES PATENT AND TRADEMARK OFFICE

CERTIFICATE OF CORRECTION

PATENT NO. : 4,825,630

DATED : May 2, 1989

INVENTOR(S) : Paul A. Czelusniak, Jr., et al.

It is certified that error appears in the above-identified patent and that said Letters Patent is hereby corrected as shown below:

IN THE CLAIMS:

Column 4, Line 62, after "holding" insert --and--.

Signed and Sealed this

Twelfth Day of December, 1989

*Attest:*

JEFFREY M. SAMUELS

*Attesting Officer*

*Acting Commissioner of Patents and Trademarks*